US005322221A

United States Patent [19]

Anderson

[11] Patent Number: 5,322,221

[45] Date of Patent: Jun. 21, 1994

[54] AIR NOZZLE

[75] Inventor: Richard D. Anderson, Maple Grove, Minn.

[73] Assignee: Graco Inc., Golden Valley, Minn.

[21] Appl. No.: 107,459

[22] Filed: Aug. 17, 1993

Related U.S. Application Data

[63] Continuation-in-part of Ser. No. 973,846, Nov. 9, 1992.

[51] Int. Cl.[5] ..... B05B 7/12

[52] U.S. Cl. ..... 239/291; 239/296; 239/300

[58] Field of Search ..... 239/290, 291, 296, 299, 239/300

[56] References Cited

U.S. PATENT DOCUMENTS

| | | | |
|---|---|---|---|
| 1,910,673 | 5/1933 | Bramsen | 239/300 |
| 2,146,416 | 2/1939 | Bramsen et al. | 239/300 |
| 2,281,666 | 5/1942 | Bramsen et al. | 239/300 |
| 2,348,568 | 5/1944 | Pellar | 239/300 |
| 2,518,759 | 8/1950 | Dalrymple | 239/300 |
| 2,559,407 | 7/1951 | Dalrymple | 239/300 |
| 2,578,402 | 12/1951 | Dalrymple | 239/300 |
| 2,626,122 | 1/1953 | Lammiman | 239/300 |
| 2,843,425 | 7/1958 | Paasche | 239/300 |
| 3,168,250 | 2/1965 | Paasche | 239/300 |
| 5,064,119 | 11/1991 | Mellette | 239/8 |
| 4,728,039 | 3/1988 | Johnson et al. | 239/296 |
| 4,927,079 | 5/1990 | Smith | 239/300 X |
| 4,961,536 | 10/1990 | Correard | 239/300 X |
| 4,993,642 | 2/1991 | Hufgard | 239/300 |
| 5,080,285 | 1/1992 | Toth | 239/300 |
| 5,090,623 | 2/1992 | Burns et al. | 239/300 X |
| 5,152,460 | 10/1992 | Barty | 239/300 X |
| 5,199,644 | 4/1993 | Haferkorn | 239/296 |

FOREIGN PATENT DOCUMENTS

| | | | |
|---|---|---|---|
| 100535 | 3/1937 | Australia | 239/300 |
| 456523 | 11/1991 | European Pat. Off. | 239/300 |

*Primary Examiner*—Andres Kashnikow
*Assistant Examiner*—Lesley D. Morris
*Attorney, Agent, or Firm*—Palmatier, Sjoquist & Helget

[57] ABSTRACT

A spray gun apparatus having air passages for the atomization of liquid passing through a liquid outlet orifice, and having air passages for directing air flow against the atomized particles emitting from the spray orifice, wherein the atomizing air passages are separated from the fan air passages, and an adjustable control valve selectively controls the volume of air through the fan air passages. The spray apparatus has an air spray nozzle including a spray nozzle concentrically fitted into an air cap, both parts being precisely aligned along a common axis; the air cap includes a contoured groove for smoothly directing air flow to fan air orifices.

3 Claims, 3 Drawing Sheets

AIR NOZZLE

This application is a continuation-in-part of a copending application for "Air Spray Gun Having Independent Fan Control," Ser. No. 07/973,846, pending, filed Nov. 9, 1992.

BACKGROUND OF THE INVENTION

The present invention relates to spray guns for spraying coating materials such as paint or the like. More particularly, the invention relates to an air spray gun operable under extremely low air pressure conditions.

The use of pressurized air in connection with a spray gun for assisting in the atomization and delivery of sprayed liquid particles is well known. Prior art air spray guns have utilized air under pressure, both for atomizing liquid delivered to the spray gun into fine particles, and also for shaping the cloud of particles emanating from the spray gun. Such spray guns typically utilize air pressures ranging up to approximately 100 pounds per square inch (psi). Some of the problems in utilizing air pressures in this range include the problem of overspray, wherein a very large cloud of liquid particles are emitted at significant velocities, tending to create overspray; i.e., spray which passes by the article to be coated and becomes a source of pollution in the atmosphere. Another problem in utilizing higher air pressures is in the need to deliver significant volumes of air under significant pressures, thereby requiring a considerable amount of energy for producing the requisite pressurized air conditions.

Fairly recent prior art has addressed these problems and, as a result thereof, spray guns have been developed which provide atomizing air at pressures of approximately 10 psi, at relatively high flow rates; i.e., in the range of 18–25 cubic feet per minute (cfm). Spray guns of this general type are known as "high volume low pressure" (HVLP) spray guns, and they provide a higher transfer efficiency in the application of liquid coating materials to articles. They utilize a higher pressure air inlet to the spray gun, and an adjustable pressure restrictor in the air flow passage internal to the spray gun. The air passages downstream from the pressure restrictor are divided into air atomizing passages and fan air passages. The air atomizing passages convey the pressurized air to the liquid orifice outlet, wherein liquid emitted through the outlet becomes atomized under the influence of the pressurized air. The fan air passages are directed to various openings in the spray nozzle, surrounding the atomizing orifice, positioned so as to influence the shape of the atomized cloud of particles which are emitted from the orifice. In a typical spray gun of this type both the air atomizing passages and the fan air passages receive air from the same adjustable valve, and the air pressures are substantially the same through both sets of passages. One example of a spray gun of this type is shown in U.S. Pat. No. 5,064,119, issued Nov. 12, 1991.

A problem with this general type of spray gun is that the adjustment feature affects both the air atomizing passages and the fan air passages simultaneously; when the atomizing air pressure is increased or reduced a corresponding change of the fan air pressure is also produced. This consequence is not always desirable, for in many cases it is desirable to atomize at a very low air pressure, while maintaining a relatively higher air pressure for shaping the air spray fan. This limitation frequently restricts the usefulness of such spray guns. In the case of spraying liquids which are difficult to atomize, it is sometimes necessary to increase the total air flow to a point where overspray is excessive and air energy is wasted, thereby defeating the purpose of HVLP spray guns for gaining higher transfer efficiencies. This condition is difficult to accommodate with existing spray guns, unless two different pressure sources are connected to the spray guns, each source being independently controllable to provide the optimum pressure and flow rate for the respective tasks of controlling atomization and controlling pattern fan size and shape.

SUMMARY OF THE INVENTION

The present invention comprises an air nozzle for a spray gun for spraying liquids in an atomized pattern under the influence of pressurized air. The invention overcomes the disadvantages of the prior art, by providing a single air source connection to a spray gun, with independently controllable passages for atomizing air and fan air. The invention comprises a novel air nozzle construction for HVLP spray guns, wherein the air nozzle incorporates an annular contoured passageway for smoothly directly the flow of low-pressure air from the spray gun passages to fan air passages at the forward end of the nozzle. The invention also includes a positive seating and positioning construction for optimally locating the spray orifice in relation to the air atomizing passages; the positioning feature providing a precise, concentric relationship between the spray orifice and the surrounding air atomizing passages.

The principal object of the present invention is to provide an air spray gun and air nozzle having a first low air pressure for atomizing air and a second adjustable intermediate pressure for pattern fan control air.

It is another object of the present invention to provide an air spray gun having a single air inlet and dual air pressure control, through the use of pressure restrictors internal to the spray gun.

It is another object of the present invention to provide an air nozzle for smoothly directing fan air under smooth, balanced flow conditions to fan air passages.

It is a further object of the invention to provide good spray fan pattern performance by a construction of the air nozzle to positively and concentrically position the spray orifice relative to the air atomizing passages.

Other and further objects will become apparent from the specification and claims, and with reference to the appended drawings.

DESCRIPTION OF THE PREFERRED EMBODIMENT

Figure 1:
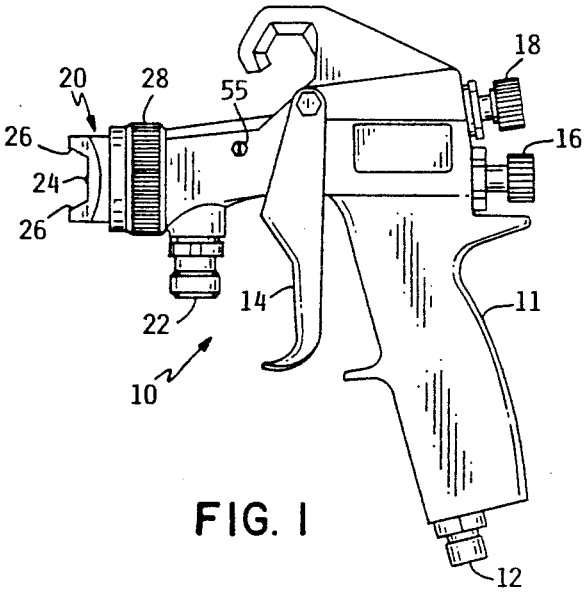
FIG. 1 shows an elevation view of the present invention.

Referring first to FIG. 1, a spray gun 10 is shown in elevation view. Spray gun 10 has a handle 11, with an air inlet port 12 at the bottom of the handle. A liquid inlet port 22 is also a part of the body of the spray gun 10, and a trigger 14 is pivotally attached to the spray gun for control over the air and liquid materials which flow through the spray gun. The volume flow rate of liquid through the spray gun may be adjusted by adjustable knob 16; the volume flow rate of so-called "fan air" through the gun may be adjusted by knob 18.

A spray nozzle 20 is threadably attached to the front of spray gun 10. An air cap 33 is attached to the front end of spray gun 10 by means of a threaded nut 28. Spray nozzle 20 includes a spray orifice 24, and air cap 33 includes at least a pair of air "horns" 26, which are forwardly projecting members having air passages therein.

Figure 2:
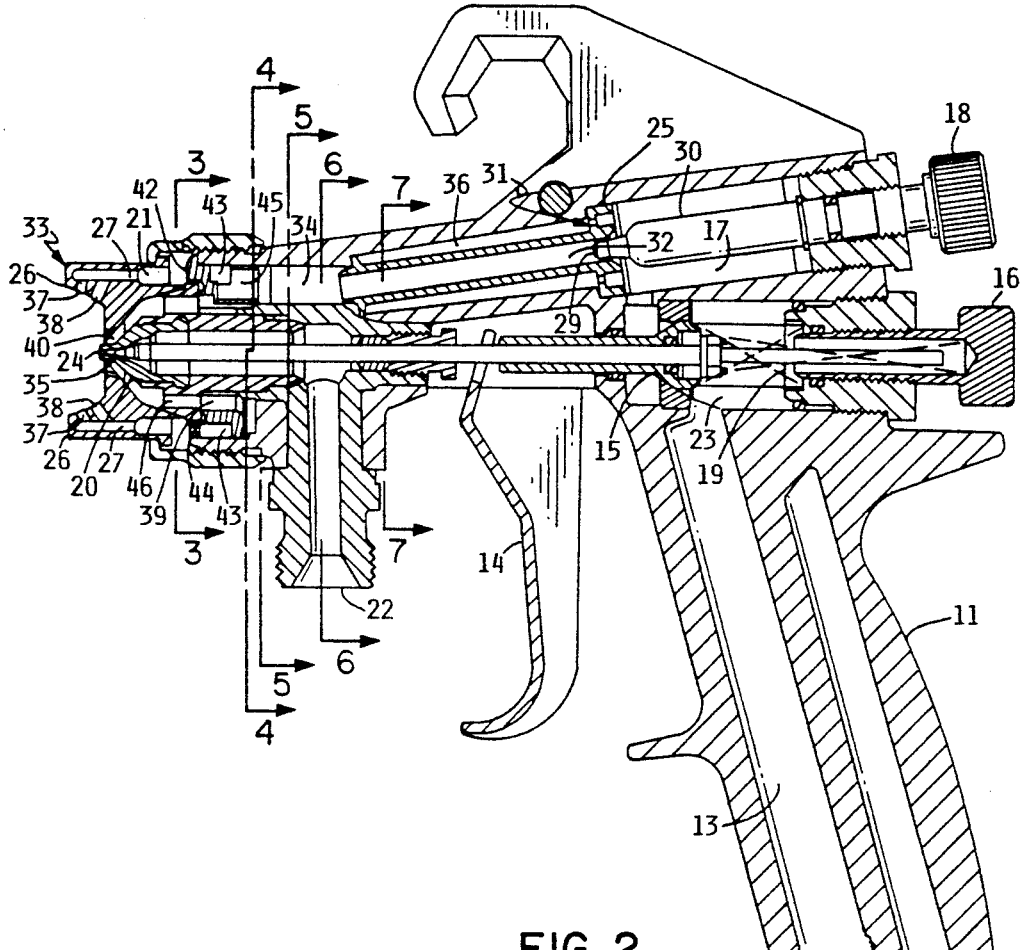
FIG. 2 shows an elevation cross-sectional view of the present invention.

FIG. 2 shows the spray gun 10 in elevation cross-sectional view. Air inlet 12 is coupled to a passage 13 in handle 11 of the spray gun. Passage 13 opens into a trigger valve chamber 23, the outlet of which is controlled by a valve member 15. Valve member 15 is engageable by trigger 14, such that when trigger 14 is squeezed valve member 15 moves rearwardly to permit air flow from chamber 23 into chamber 17. Chamber 17 has two outlets; a first outlet 29 is controlled by a valve 30, and a second outlet 31 is comprised of a plurality of openings through a flow restrictor 25. The valve 30 is selectively adjustable by knob 18 to a position of full closure against outlet 29, or knob 18 may be adjusted to permit an orifice of selectable size to exist between outlet 29 and valve 30. Knob 18 therefore controls the air flow through outlet 29 and into passage 32. The air flow in passage 32 passes into passage 34, and from there into the air cap 33 of spray nozzle 20 in a manner which will be hereinafter described.

A removable plug 55 is affixed into the sidewall of spray gun 10. Plug 55 closes a port which connects to a passage intersecting chamber 36. Plug 55 may be removed in certain applications to permit the coupling of a pressure tube to spray gun 10, and the pressure tube may lead to an external reservoir of liquid, to pressurize the external reservoir, so that the liquid in the reservoir may be coupled to spray gun 10 via inlet 22.

The air which flows from chamber 17 through restrictor outlet 31 flows into chamber 36, which surrounds passage 32 but is isolated therefrom. The air flow in chamber 36 is coupled to further passages in nozzle 20 as will be hereinafter described. A needle valve 35 is controllable by trigger 14, to permit the passage of liquid from liquid inlet 22 through the nozzle 20 of the spray gun.

Nozzle 20 has a liquid spray orifice 24, and air passages 40 form an annular air orifice about the liquid spray orifice 24. Air passages 27 in air cap 33 convey air from passage 34 to air orifices 37, 38, which are inclined toward the axis of spray orifice 24. Air orifices 37, 38 provide air for shaping the pattern of the atomized liquid particles which emanate from liquid orifice 24. The liquid particles which emanate from liquid orifice 24 tend to leave orifice 24 in a circular pattern, and the air orifices 37, 38 tend to flatten the circular pattern into more of a fan shape.

The air supplied to the vicinity of liquid orifice 24 for atomizing the liquid particles that emanate therefrom is provided via passages 40 which form the annular air orifice about spray orifice 24. The air which passes through passages 40 is conveyed via passage 39 in a manner which will be hereinafter described.

Figure 7:
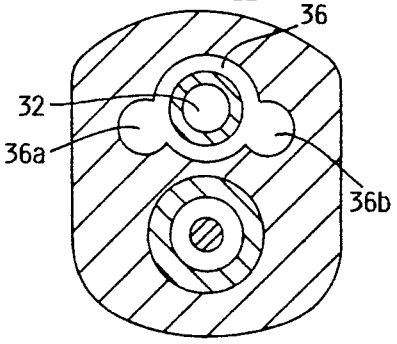
FIG. 7 shows a cross-sectional view taken along the lines 7—7 of FIG. 2.

Referring next to FIG. 7, a cross-sectional view taken along the lines 7—7 of FIG. 2 is illustrated, showing air chamber 36 surrounding air passage 32. Air chamber 36 has side lobe passages 36*a* and 36*b*, which are formed as cavities in the interior body of spray gun 10.

Figure 6:
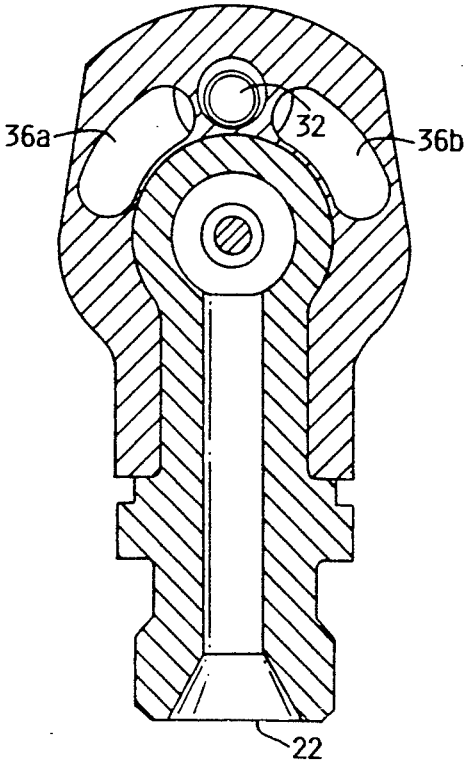
FIG. 6 shows a cross-sectional view taken along the lines 6—6 of FIG. 2.

FIG. 6 shows a cross-sectional view taken along the lines 6—6 of FIG. 2, illustrating passages 36*a* and 36*b* as enlarged and separated cavity portions.

Figure 5:
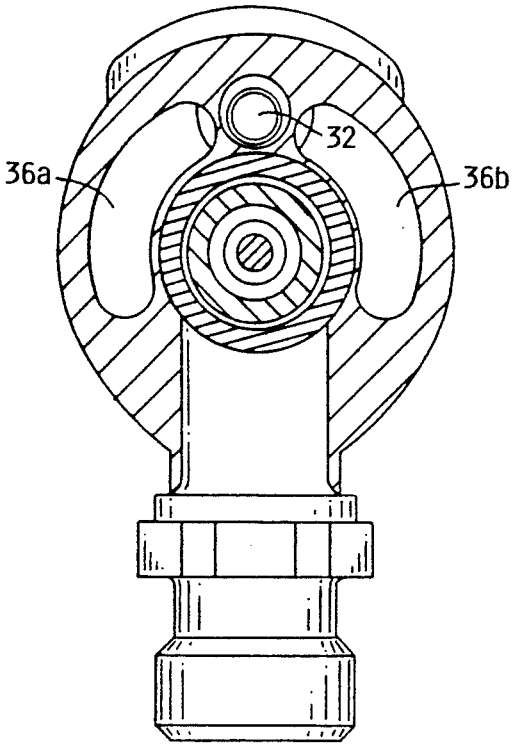
FIG. 5 shows a cross-sectional view taken along the lines 5—5 of FIG. 2.

FIG. 5 shows a cross-sectional view taken along the lines 5—5 of FIG. 2, showing a further enlarged chamber 36*a* and 36*b*.

Figure 4:
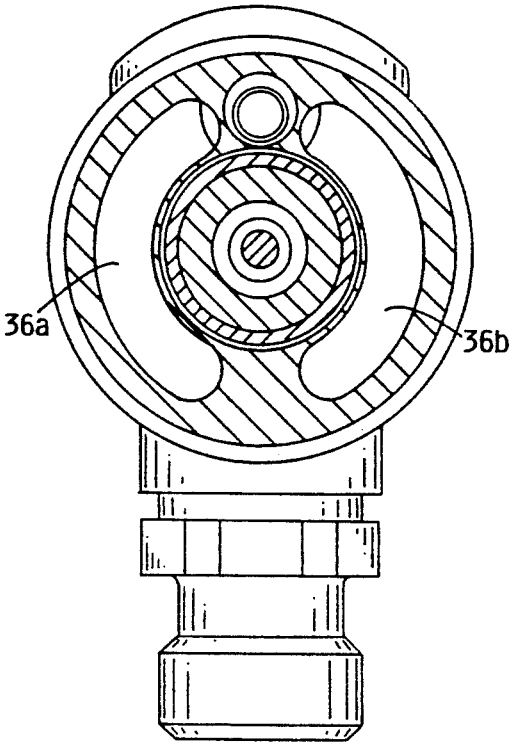
FIG. 4 shows a cross-sectional view taken along the lines 4—4 of FIG. 2.

FIG. 4 shows a cross-sectional view taken lines 4—4 of FIG. 2, showing a still further enlarged chamber 36*a* and 36*b*. Passages 36*a* and 36*b* are formed about the respective sides of spray gun body 10, and communicate with an annular passage 39 which is shown in FIG. 2.

Figure 3:
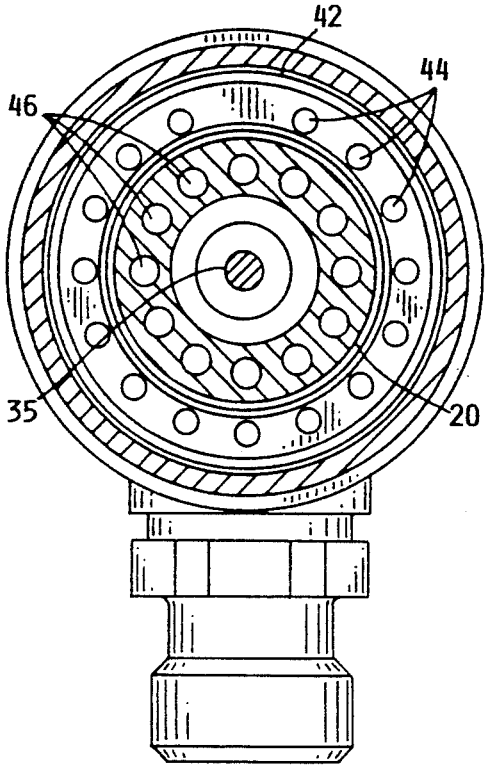
FIG. 3 shows a cross-sectional view taken along the lines 3—3 of FIG. 2.

FIG. 3 shows a cross-sectional view taken along the lines 3—3 of FIG. 2, illustrating an air baffle 42 which is sealably affixed about the front opening of spray gun body 10. Air baffle 42 provides a plurality of openings 44 to permit the passage of air into passages 27 in air horns 26. Air baffle 42 also has an annular groove 43 which permits the passage of air from an inlet passage 45, into annular groove 43, and out through openings 44 (see FIG. 2). The air flow into inlet passage 45 is conveyed via passages 32, 34. The air flow through passages 40 in nozzle 20 is conveyed via chambers 36, 36*a*, 36*b*, 39 and 46. The air flow through orifices 37, 38 is therefore isolated from the air flow through the annular orifice formed by passages 40.

The amount of air which is permitted to pass into passage 32, and therefore through orifices 37, 38, is controllable by the selective adjustment of fan control knob 18. The amount of air flowing into chamber 36, and therefore through annular orifice 40 is controllable by selecting the size of orifice openings 31 in the flow restrictor 25.

Figure 8:
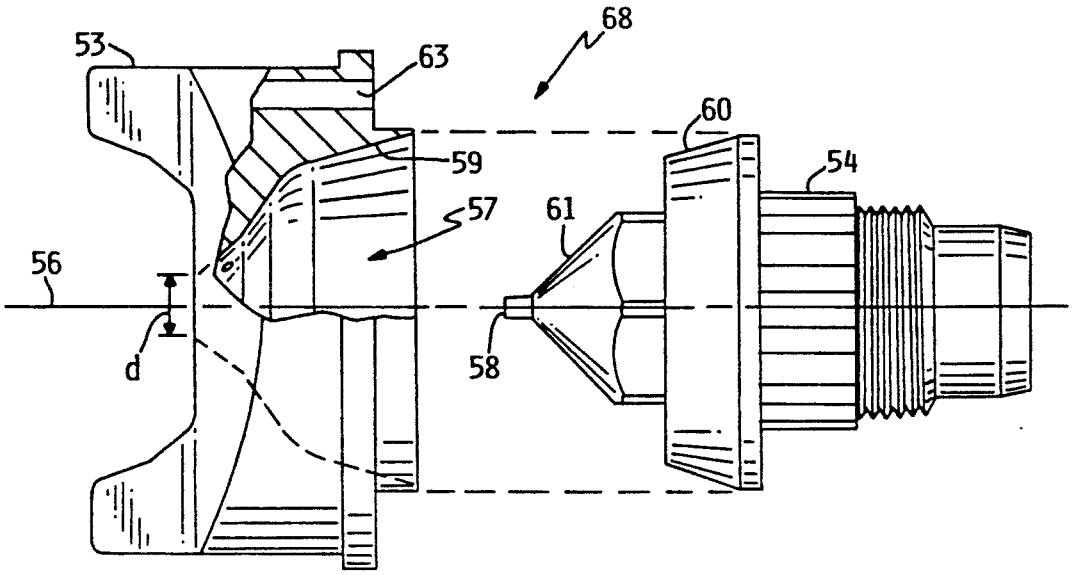
FIG. 8 (PRIOR ART)
FIG. 8 shows an air nozzle constructed according to the teachings of the prior art.

FIG. 8 shows an air spray nozzle 68 of the type utilized in the prior art. Air spray nozzle 50 comprises an air cap 53 and a spray nozzle 54. Air cap 53 and spray nozzle 54 are preferably aligned along a common axis 56, by partially inserting spray nozzle 54 into the rear interior cavity 57 formed in air cap 53. Cavity 57 opens through the front surface of air cap 53 to form an opening of diameter "d," and spray orifice 58 is preferably concentrically aligned within the opening "d," with the spray orifice 58 projecting slightly forwardly of the front surface of air cap 53. Air passages 40 (see FIG. 2) are formed between the inner surface of cavity 57 and the outer surface 61 of spray nozzle 54, to create an annular air opening about spray orifice 58. The air flowing through air passages 40 therefore provides a circumferential air flow about spray orifice 58, and atomizes the liquid emanating from spray orifice 58 into a circular atomization pattern. It is critical that spray orifice 58 be precisely centrally located along axis 58, so that the annular air passages 40 are uniform about the entire circumference of spray orifice 58; any misalignment off-axis 56 will distort the uniform air flow pattern and will therefore distort the atomized shape of the particles emanating from spray orifice 58. In the prior art, the concentric alignment of spray nozzle 54 within air cap 53 was accomplished by the friction-fit engagement between the tapered inner cavity wall 59 and the contoured exterior surface 60 of spray nozzle 54. Spray nozzle 54 is pressed into cavity 57 so as to tightly engage surface 60 against surface 59, to attempt to maintain concentricity of spray orifice 58 within opening "d." However, since air cap 53 and spray nozzle 54 is typically machined from plastic materials, it is extremely difficult to maintain precise machining tolerances, and small angular misalignments have occurred when inserting spray nozzle 54 into air cap 53, thereby creating a slight degree of off-axis alignment of spray orifice 58. This potential for misalignment makes it extremely difficult to precisely fit spray nozzle 54 within air cap 53, particularly when it is considered that these components are frequently assembled and disassembled in the field, for cleaning and maintenance, and the field technician has not realized the significance of the misalignment problem. Another problem identified with respect to the prior art spray nozzle of FIG. 8, is the control of air flow through passages 63 which lead to the air orifices opening through the "horns" of air cap 53. It has been noted that the air flow through passages 63 is frequently turbulent air flow, leading to erratic and non-uniform air flow exiting from the exterior air orifices, which results in inadequate shaping of the "fan"; i.e., the atomization pattern emitted from the air spray nozzle.

Figure 9:
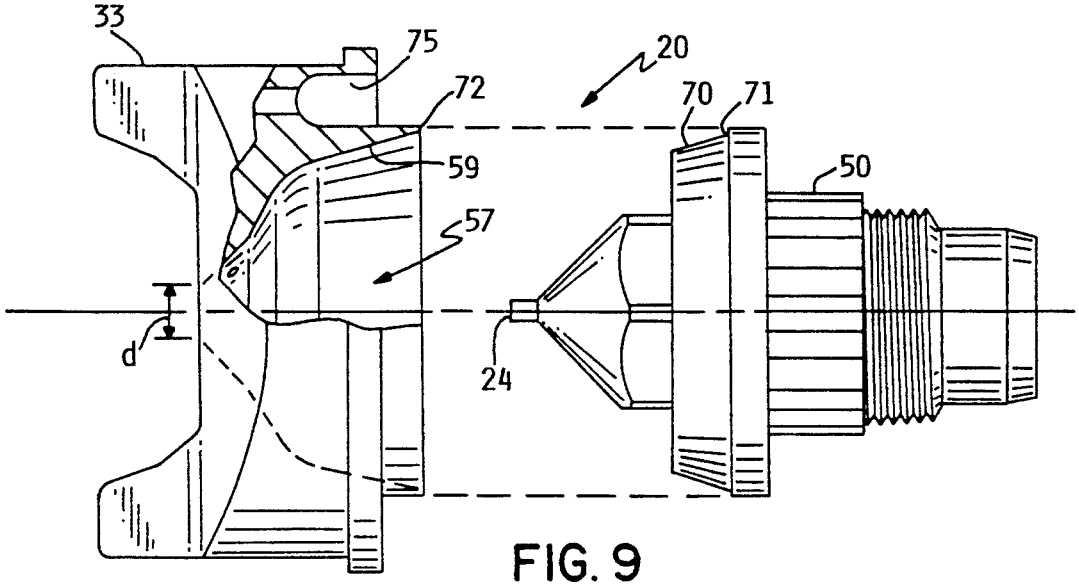
FIG. 9 shows the air nozzle of the present invention.

The foregoing deficiencies are eliminated in the air spray nozzle of the present invention, illustrated in FIG. 9. In this case, spray nozzle 50 is inserted into the identical cavity 57 in air cap 53, and the inclined surface 70 of spray nozzle 50 is pressed against the contoured internal cavity surface 59 of cavity 57. However, spray nozzle 50 has a shoulder 71 which engages against the rear surface 72 of air cap 33, thereby providing a solid reference surface for axial alignment of spray nozzle 50 within air cap 33. In this case, spray orifice 24 is precisely concentrically aligned within opening "d," for the orientation of spray nozzle 50 is precisely governed by the contact fit of shoulder 71 against surface 72. In all other respects the air passages which form the concentric air flow about spray orifice 24 are identical as found in the prior art, although the annular air passages about spray orifice 24 is assured to be uniform and concentric. A further improvement has been made in directing the air flow to the air horn passages. In this case, a contoured groove 75 has been machined into the rear surface of air cap 33 to provide a smooth transition for air flow into the fan air passages. The smooth interior curvature of groove 75 permits a smooth, balanced air flow through the passages, and thereby improves the uniformity of the fan-shaping air that is emitted from air orifices 37, 38 (see FIG. 2).

Figure 10:
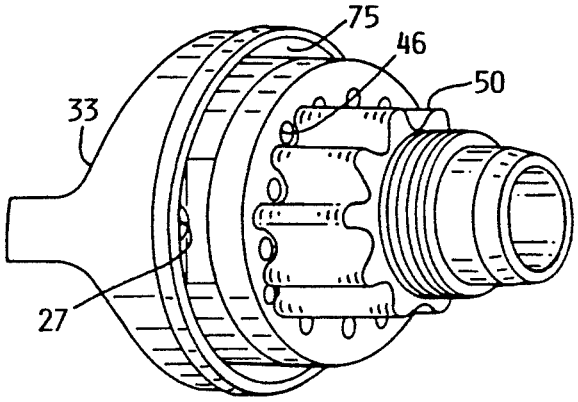
FIG. 10 shows an isometric view of the air nozzle.

FIG. 10 shows a rear isometric view of air spray nozzle 20, with spray nozzle 50 inserted into air cap 33. A plurality of air passages 46 are created through the front end of spray nozzle 50 to guide the flow of air into air passages 40 (see FIG. 2), so as to provide the concentric air flow described herein. The contoured annular groove 75 is illustrated in FIG. 10, and the opening of air passage 27 into this contoured groove 75 is also partially illustrated.

In operation, the spray gun is operated by squeezing trigger 14. Prior to squeezing trigger 14 a supply of pressurized air is provided via air inlet 12 into chambers 13 and 23. The initial movement caused by squeezing trigger 14 causes air valve 15 to become unseated, thereby permitting the flow of pressurized air from trigger valve chamber 23 into chamber 17. The pressurized air in chamber 17 flows through the orifice 31 in restrictor 25 to the annular air orifice 40 surrounding liquid orifice 24, thereby to provide an initial flow of air through the annular air orifice prior to any liquid flow through the spray gun. The size of orifices 31 in restrictor 25 controls the air flow volume for atomizing the liquid through the spray gun. By proper selection of the size of orifices 31, it is possible to closely and consistently control the atomizing air even when the valve 30 is closed off.

Pressurized air from chamber 17 is also selectively permitted to flow into passage 32 by prior adjustment of fan air adjustment knob 18. The pressurized air permitted into passage 32 then flows through the passages herein described and out through orifices 37, 38 in air cap 33. This independent control of fan air permits a wider range of spray pattern control than is possible with prior art spray guns. This in turn permits improvements in spraying production times, because good atomization and spray pattern control is achieved at higher liquid flow rates.

As trigger 14 is squeezed further, the trigger force acts against the spring force of spring 19 to cause needle valve 35 to withdraw from its seated position in the spray nozzle 20, thereby permitting the passage of liquid through the spray gun from inlet 22 to orifice 24. As liquid is emitted from orifice 24 it immediately encounters the atomizing force of the air flow being emitted through the annular orifice 40 surrounding liquid orifice 24, and the liquid becomes atomized in a circular pattern. The atomized particles are forced forwardly from the spray gun, and encounter the air flow emitted from the respective orifices 37, 38, which air flow creates forces to shape the circular atomized pattern into a flattened atomized pattern, which pattern is then propagated forwardly away from the spray gun. By selectively adjusting knob 18 a predetermined amount of shaping air flow is controllably directed against the atomized particles. By selectively adjusting knob 16 a predetermined liquid flow is permitted through the opening provided by the rearward position of needle valve 35 relative to its seated position.

When the spray gun trigger is released needle valve 35 initially closes and stops the flow of liquid through the spray gun. Air valve 15 subsequently closes to stop the flow of air through the air cap 33 and also to stop the flow of atomizing air about liquid orifice 24.

When air is flowing through the passages in spray gun 10, an initial air pressure drop is caused by restrictor 25, thereby permitting application of a higher pressure air line to inlet 12 while at the same ensuring a lower pressure air flow throughout the spray gun passages. This lower pressure air passes from chamber 17 through the openings in restrictor 25 into chamber 36. This air then flows into chambers **36*a*, 36*b*, annular passage 39, openings 46, passages 40, and through the annular opening about liquid passage 24. The pressurized air in chamber 17 also may be permitted to pass into passage 32 by adjustment of knob 18, and thence into passage 34, through inlet port 45 and into annular groove 43, through openings 44 in baffle 42, into annular groove 75 and passages 27, and outwardly through orifices 37, 38 in air cap 33. It is therefore apparent that the volume flow rate of air may be selectively controlled so as to provide a different flow rate for atomizing air than is provided for fan air or shaping air at the front of the spray gun. This variable adjustment feature is possible even though only a single source of higher pressure air is applied to the inlet of the spray gun. The feature also permits a flow of atomizing air through the spray gun even when the fan air is completely shut off by closing valve 30**.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An improvement in an air spray nozzle for use on an air spray apparatus wherein a single source of pressurized air is connected to the apparatus and separate passages within the apparatus create a first and second air flow conduit to the air spray nozzle, the improvement comprising:

a) an air cap having a contoured inner cavity symmetrically arranged about an axis, the cavity opening through a rear surface of the air cap and contoured to a smaller front opening through the front surface of said air cap, the front opening being symmetrical about said axis; and said air cap further comprising an annular groove in said rear surface, said annular groove having a curved bottom surface and fan air passages opening through said curved bottom surface; said annular groove being positioned to receive air flow from said first air flow conduit; and b) a spray nozzle having a tapered surface sized to engage inside said cavity, and a shoulder adjacent said tapered surface, said shoulder contacting the rear surface of said air cap, thereby aligning said spray nozzle along said axis; and said spray nozzle further comprising a forwardly-projecting spray orifice, said spray orifice being concentrically positioned in said front opening and aligned along said axis.

2. The improvement of claim 1, wherein said spray nozzle further comprises a plurality of openings in flow communication with air flow from said second air flow conduit.

3. The improvement of claim 2, further comprising an air chamber concentrically arranged about said axis and formed as a result of the engagement of said spray nozzle in said air-cap cavity, said chamber formed between said cavity inner surface and said spray nozzle.

* * * * *